US009366489B1

(12) United States Patent
Strom

(10) Patent No.: US 9,366,489 B1
(45) Date of Patent: Jun. 14, 2016

(54) FIREARM CHARGING HANDLE

(71) Applicant: AR Products LLC, Brooklyn Park, MN (US)

(72) Inventor: Kevin Strom, Brooklyn Park, MN (US)

( * ) Notice: Subject to any disclaimer, the term of this patent is extended or adjusted under 35 U.S.C. 154(b) by 0 days.

(21) Appl. No.: 14/603,075

(22) Filed: Jan. 22, 2015

(51) Int. Cl.
*F41A 3/72* (2006.01)
*F41A 35/06* (2006.01)

(52) U.S. Cl.
CPC .. *F41A 3/72* (2013.01); *F41A 35/06* (2013.01)

(58) Field of Classification Search
CPC ..... F41A 3/72; F41A 35/06; F41A 19/34; F41A 7/02
USPC ..... 42/69.01, 87, 85, 106, 1.11, 90; 89/1.4
See application file for complete search history.

(56) References Cited

U.S. PATENT DOCUMENTS

| | | | | |
|---|---|---|---|---|
| 2,332,631 | A * | 10/1943 | Gasser | F41A 7/02 74/471 R |
| 2,782,688 | A * | 2/1957 | Leek | F41A 7/02 42/75.02 |
| 5,690,089 | A * | 11/1997 | Ward | F41B 7/00 124/16 |
| 7,231,861 | B1 * | 6/2007 | Gauny | F41A 3/72 42/16 |
| 7,708,246 | B1 * | 5/2010 | Trask | A63B 29/024 182/3 |
| 7,861,635 | B1 | 1/2011 | Hoel | |
| 7,900,546 | B2 | 3/2011 | Bordson | |
| 8,261,649 | B2 | 9/2012 | Fitzpatrick et al. | |
| D705,383 | S | 5/2014 | Montes | |
| D705,384 | S * | 5/2014 | Underwood | D22/108 |
| 8,820,210 | B2 | 9/2014 | Melville | |
| 8,863,632 | B1 | 10/2014 | O'Malley | |
| 2010/0251880 | A1 * | 10/2010 | Hektoen | F41A 7/02 89/1.4 |
| 2011/0174139 | A1 * | 7/2011 | Olsen | F41A 35/06 89/1.4 |
| 2011/0214558 | A1 * | 9/2011 | Kincel | F41A 9/00 89/1.4 |
| 2014/0020549 | A1 | 1/2014 | Bayly | |
| 2014/0060293 | A1 | 3/2014 | Gomez | |

FOREIGN PATENT DOCUMENTS

GB 190603100 A * 0/1907

OTHER PUBLICATIONS

NPL: http://www.defensereview.com/rainier-arms-raptor-ambi-charging-handle-ambidextrous-charging-handle-by-axts-weapons-systems-for-ar-15-tactical-carbinesbrs-and-ar-10sr-25-tactical-riflecarbines/ Aug. 29, 2013*

NPL: http://www.militaryfirearm.com/Forum/archive/index.php/t-22919.html Feb. 9, 2012.*

* cited by examiner

*Primary Examiner* — Samir Abdosh
*Assistant Examiner* — John D Cooper
(74) *Attorney, Agent, or Firm* — Brooks, Cameron & Huebsch, PLLC

(57) ABSTRACT

A charging handle for a firearm having an elongate member, a bolt engaging element at a forward end, a handle portion at a rearward end, the handle portion including a first projection from the elongate member and a second projection from the elongate member opposing the first projection, the first projection having a first surface defining an elongate opening at least partially therethrough extending substantially parallel with a longitudinal axis of the elongate member and configured to receive a first end of a lanyard, and the second projection having at least one surface defining a pivot point opening with a pivot axis substantially perpendicular to the longitudinal axis of the elongate member, and a latch having a surface defining a first opening therethrough, where the latch pivots around a pivot pin positioned through the pivot opening and the first opening through the latch.

19 Claims, 6 Drawing Sheets

FIREARM CHARGING HANDLE

FIELD OF DISCLOSURE

Embodiments of the present disclosure are directed to firearms, specifically charging handles for automatic and semi-automatic firearms.

BACKGROUND

A charging handle (or charge handle) can be incorporated for ejecting spent cartridges and loading the chamber of a firearm, such as an M-16, AR-10, AR-15, or M-4. The charging handle can be configured to move the bolt assembly or carrier back and forth by means of a bolt engaging element at a forward end of the charging handle rod. Common charging handles are configured as an elongate rod with a rearward handle disposed in a perpendicular orientation with respect to the rod (commonly described as a "T" shape); the handle is grasped and pulled backward, which moves the rod (and the bolt carrier to which it is engaged) in a rearward direction. Charging handles can include latching mechanisms, commonly called tactical latches, to prevent unintended rearward movement of the charging handle during operation or inspection of the weapon. The forward end of the latch engages a detent on the side of the receiver housing, thereby holding the charging handle in position.

While these firearms have certain recognized advantages in different situations, problems have been identified with commonly available charging handles. For example, most charging handles have been designed for right-handed operators; supporting the rifle with the left hand, the operator uses two fingers of the right hand (one on either side of the charging handle rod) to pull rearwards on the charging handle in a straight line parallel to the bolt carrier of the rifle, requiring the operator to remove the right hand from the weapon trigger.

Ambidextrous charging handles have been developed in an attempt to address this, but it has been noted that such handles do not always pull the rod parallel with the bolt carrier as originally designed, but rather cause some degree of rotation and resultant stress on the rod. This creates resistance while trying to pull the bolt carrier to the rear of the weapon, resulting in increased wear on the pin, rod and upper receiver.

In some instances, an operator's dexterity may be limited when operating a charging handle. For example, the operator may be wearing gloves or may have been injured during combat. Also, the addition of one or more optics (e.g., a top-mounted scope) may interfere with the ability for an operator to grasp a commonly available charging handle with two fingers in order to pull the charging handle rearwards. Charging handles having oversized handle protrusions, often perpendicular to the firearm, have been developed to address these issues. However, these approaches yield similar problems caused by rotational stress on the rod including increased wear on the pin, rod and upper receiver. Further, it has been found that many charging handles, with their oversized handle protrusions, present a potential for snagging on clothing, which can disrupt operation of the firearm at a crucial moment.

Thus, it is desired to provide a firearm charging handle that does not have the ineffectiveness or drawbacks of the above described charging handles.

SUMMARY

The present disclosure therefore seeks to provide a firearm charging handle that allows a more intuitive operation and can address the issues around some currently available charging handles.

One or more embodiments of the present disclosure include a charging handle for a firearm, a charging handle assembly for a firearm, and a firearm including a charging handle assembly. For the various embodiments, the charging handle includes: an elongate member having a forward end and a rearward end with a longitudinal axis extending therethrough, a bolt engaging element at the forward end, a handle portion at the rearward end, the handle portion including a first projection from the elongate member and a second projection from the elongate member opposing the first projection, the first projection having a first surface defining an elongate opening at least partially therethrough extending substantially parallel with the longitudinal axis of the elongate member and configured to receive a first end of a lanyard, and the second projection having at least one surface defining a pivot point opening with a pivot axis substantially perpendicular to the longitudinal axis of the elongate member, a pivot pin in the pivot point opening, and a latch having a surface defining a first opening therethrough, the pivot pin passing through the first opening to allow the latch to pivot around the pivot pin positioned through the pivot opening and the first opening through the latch.

In one or more embodiments, the charging handle assembly includes an elongate member having a forward end and a rearward end with a longitudinal axis extending therethrough, a bolt engaging element at the forward end, a handle portion at the rearward end, the handle portion including a first projection from the elongate member and a second projection from the elongate member opposing the first projection, the first projection having a first surface defining an elongate opening at least partially therethrough extending substantially parallel with the longitudinal axis of the elongate member and configured to receive a first end of a lanyard, and the second projection having at least one surface defining a pivot point opening with a pivot axis substantially perpendicular to the longitudinal axis of the elongate member, a pivot pin in the pivot point opening, a latch having a surface defining a first opening therethrough, the pivot pin passing through the first opening to allow the latch to pivot around the pivot pin positioned through the pivot opening and the first opening through the latch, and a lanyard having at least one filament with a first end portion and a second end portion opposite the first end portion, the first end portion passing through the elongate opening of the first projection and the second end portion passing through the second opening of the latch to form a loop portion, where each of the first end portion and the second end portion is modified to prevent the loop from being broken.

In one or more embodiments, the firearm includes a firearm charging handle including an elongate member having a forward end and a rearward end with a longitudinal axis extending therethrough, a bolt engaging element at the forward end, a handle portion at the rearward end, the handle portion including a first projection from the elongate member and a second projection from the elongate member opposing the first projection, the first projection having a first surface defining an elongate opening at least partially therethrough extending substantially parallel with the longitudinal axis of the elongate member and configured to receive a first end of a lanyard, and the second projection having at least one surface defining a pivot point opening with a pivot axis substantially perpendicular to the longitudinal axis of the elongate member, a pivot pin in the pivot point opening, and a latch having a surface defining a first opening therethrough, the pivot pin passing through the first opening to allow the latch to pivot around the pivot pin positioned through the pivot opening and the first opening through the latch.

The above summary of the present disclosure is not intended to describe each disclosed embodiment or every implementation of the present disclosure. The description that follows more particularly exemplifies illustrative embodiments.

BRIEF DESCRIPTION OF THE DRAWINGS

The following drawings illustrate non-limiting embodiments of the present disclosure, wherein.

DETAILED DESCRIPTION

Figure 1:
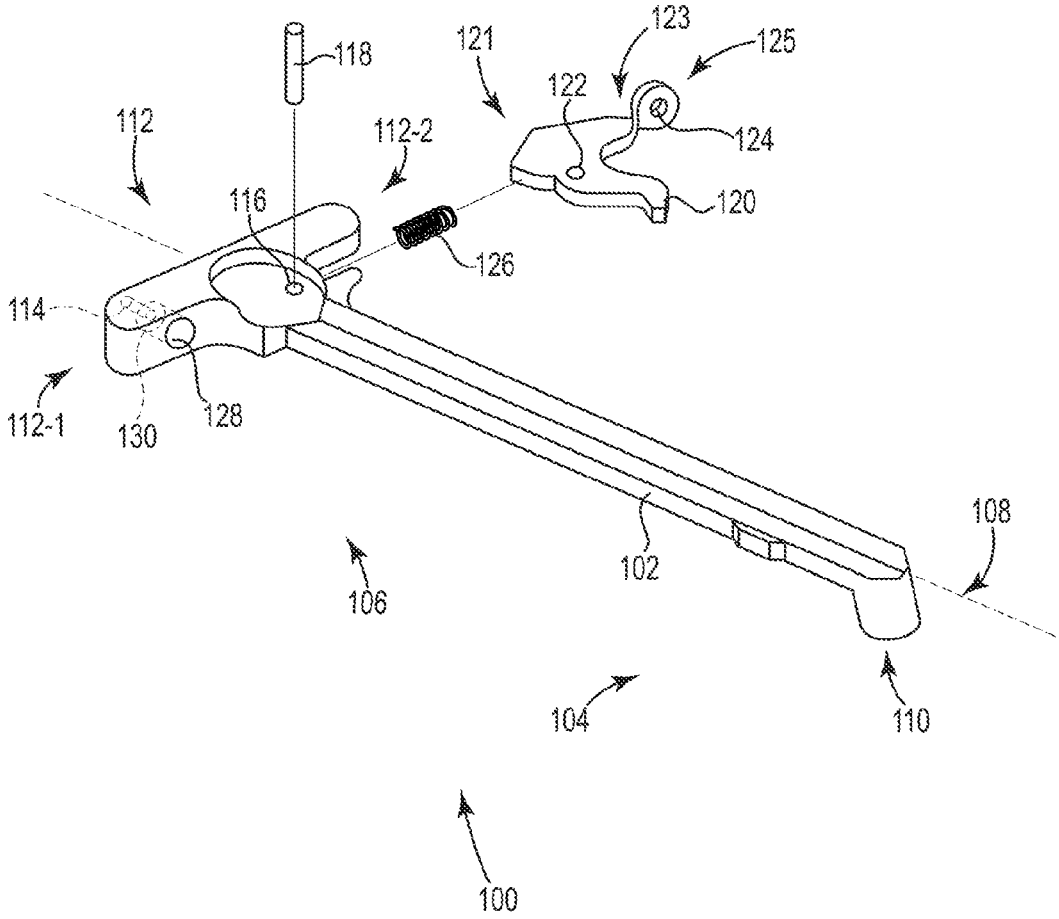
FIG. 1 illustrates an exploded view of a charging handle according to one or more embodiments of the present disclosure.

In the following detailed description of the present disclosure, reference is made to an accompanying drawing that forms a part hereof, and in which is shown by way of illustration how one or more embodiments of the disclosure may be practiced. These embodiments are described in sufficient detail to enable those of ordinary skill in the art to practice the embodiments of this disclosure, and it is to be understood that other embodiments may be utilized and that process, chemical and/or structural changes may be made without departing from the scope of the present disclosure.

The figures herein follow a numbering convention in which the first digit or digits corresponds to the drawing figure number and the remaining digits identify an element in the drawing. Similar elements between different figures may be identified by the use of similar digits. For example, 102 may reference element "02" in FIG. 1, and a similar element may be referenced as 202 in FIG. 2. The proportion and the relative scale of the elements provided in the figures are intended to illustrate various embodiments of the present invention and are not to be used in a limiting sense.

The present disclosure provides embodiments for a firearm charging handle, a firearm charging handle assembly, and a firearm including the firearm charging handle assembly. One or more embodiments according to the present disclosure allow for disengagement of the charging handle latch and rearward movement of the charging handle, and the bolt carrier to which it is engaged, by a simple rearward pull of a lanyard secured to the charging handle.

Embodiments of the present disclosure have been found to be particularly useful in firearm systems such as the AR-10, AR-15, M-16, and M4 series, and all subsequent AR-10 type, AR-15 type, M-16 type, and M4 type firearms and derivatives thereof. These firearm systems are manufactured and/or sold by entities such as Colt's Manufacturing Company of Hartford, Conn., Fabrique Nationale d'Herstal (FN) of Herstal, Belgium, Bushmaster Firearms International of Madison, N.C., Defense Procurement Manufacturing Services (DPMS) Panther Arms of St. Cloud Minn., and many others. However, it will be recognized by those skilled in the art that the present invention may be applied without undue effort or experimentation to other firearm types.

Unlike embodiments of the present disclosure, past approaches have been ineffective for their purpose. Some approaches (e.g., those comparable to the charging handle disclosed in U.S. Pat. No. 8,261,649 (Fitzpatrick) or U.S. Pat. No. 8,820,210 (Melville)) include an oversized protrusion extending from a side of the charging handle. These protrusions may be termed levers, knobs, handles, etc. As noted above, such protrusions do not always cause the rod to be pulled parallel with the bolt carrier as designed, but rather cause some degree of rotation and resultant stress on the rod. This can create resistance while trying to pull the bolt carrier to the rear of the firearm, resulting in increased wear on the pin, rod and upper receiver. Additionally, the protrusion may present a potential for snagging on clothing, which can disrupt operation of the firearm at a crucial moment.

Other approaches (e.g., those comparable to the charging handle disclosed in U.S. Pat. No. 7,900,546 (Bordson)) include mechanisms to allow ambidextrous operation of the charging handle. These mechanical systems may require precise mechanical movement and multiple moving parts, the operation of which may be compromised upon repeated impact or other stress.

Whereas past approaches may be ineffective, complex, and/or damaging to firearms, embodiments of the present disclosure provide for rearward travel of the charging handle parallel with a longitudinal axis of the firearm without rotation and resultant stress on the rod. Further, embodiments of the present disclosure do so without the use of costly and complex moving parts, which may be subject to mechanical failure at a time the operator needs them the most. Additionally, in contrast to previous approaches, embodiments of the present disclosure can be used by those having difficulty manipulating small parts (e.g., those with disabilities such as arthritis), those having limited strength, and/or small hands.

FIG. 1 illustrates an exploded view of a charging handle 100 according to one or more embodiments of the present disclosure. The charging handle 100 includes an elongate member 102 having a forward end 104 and a rearward end 106 with a longitudinal axis 108 extending therethrough. At the forward end 104 is a bolt engaging element 110 configured to engage a bolt carrier of a firearm and allow movement of a bolt assembly forward or rearward. At the rearward end 106 is a handle portion 112.

The handle portion 112 includes a first projection 112-1 (e.g., a first projection from the elongate member 102) and a second projection 112-2 opposing the first projection 112-1. The first projection 112-1 includes a first surface defining an elongate opening 114. The elongate opening 114 extends at least partially through the first projection 112-1 and is substantially parallel with the longitudinal axis 108. The elongate opening 114 can be configured to receive a first end of a lanyard (discussed below), for instance.

The second projection 112-2 includes at least one surface defining a pivot point opening 116 with a pivot axis substantially perpendicular to the longitudinal axis 108. The charging handle 100 can include a latch 120 which can be secured (e.g., pivotally secured) to the second projection 112-2 via a pin 118 passing through (e.g., into) the pivot point opening 116 of the second projection 112-2 and a first opening 122 through the latch 120 (the first opening 122 being defined by a surface of the latch 120).

The latch 120 can include a first portion 121 that includes the first opening 122 to receive the pivot pin 118. The first portion 121 of the latch 120 can be positioned between and substantially parallel with two major surfaces (e.g., a top and a bottom) of the handle portion 112. The latch 120 can include a second portion 123 that extends from the first portion 121 and the longitudinal axis 108 to a third portion 125 that includes a second surface defining a second opening 124. As shown, the second portion 123 can twist around an axis that passes through the first portion 121 the second portion 123 and the third portion 125 (e.g., an axis substantially perpendicular to the longitudinal axis 108). The third portion 125 is not limited to a particular shape. For example, in some embodiments, the third portion 125 may be substantially squared, and in other embodiments rounded. The third portion 125 may resemble a crosshairs (e.g., a circle having perpendicular intersecting line segments therein), for instance. In some embodiments, the third portion may be D-shaped. It is to be understood that other shapes are in accordance with embodiments of the present disclosure.

As noted, the latch 120 can be pivotally secured to the handle portion 112 (e.g., the second projection 112-2 of the handle portion 112) via the pin 118. The latch 120 can be pivotal about the pin 118 between a latched orientation and an unlatched orientation. The latch 120 can include a biasing mechanism configured to bias the latch 120 in the latched orientation. For example, the embodiment illustrated in FIG. 1 includes a spring 126 configured to bias the latch 120 in the latch orientation.

As shown in the embodiment illustrated in FIG. 1, the first projection 112-1 (e.g., the first surface of the first projection 112-1) can include a second surface defining a concentric opening 128. The concentric opening 128 can be substantially parallel with the elongate opening 114 and the longitudinal axis 108. The concentric opening 128 can have a diameter larger than a diameter of the elongate opening 114. A transition between the concentric opening 128 and the elongate opening 114 (e.g., the second surface defining the concentric opening 128 and the first surface defining the elongate opening 114) can define an annular ledge 130.

As will be discussed further below, the first end of a lanyard can be passed through the elongate opening 114, through the concentric opening 128, and can be modified and/or sized to pass back through the concentric opening 128 and seat against the annular ledge 130 (e.g., when the lanyard is pulled). Accordingly, the modification can prevent the first end of the lanyard from being withdrawn back through the elongate opening 114.

The second surface defining the second opening 124 through the latch 120 can be configured to receive a second end of the lanyard (discussed below), for instance. In some embodiments, a geometric center of the second opening 124 through the latch 120 and a geometric center of the elongate opening 114 can be disposed on a common plane parallel with the longitudinal axis 108. In some embodiments, the geometric center of the second opening 124 through the latch 120, the geometric center of the elongate opening 114, and the longitudinal axis 108 can be disposed on the common plane.

It is noted that although embodiments of the present disclosure are not intended to be limited to particular materials, the elongate member 102, the latch 120, the pin 118, and/or the spring 126 can be composed of metal or metal alloys (e.g., steel and/or aluminum), for instance.

Figure 2:
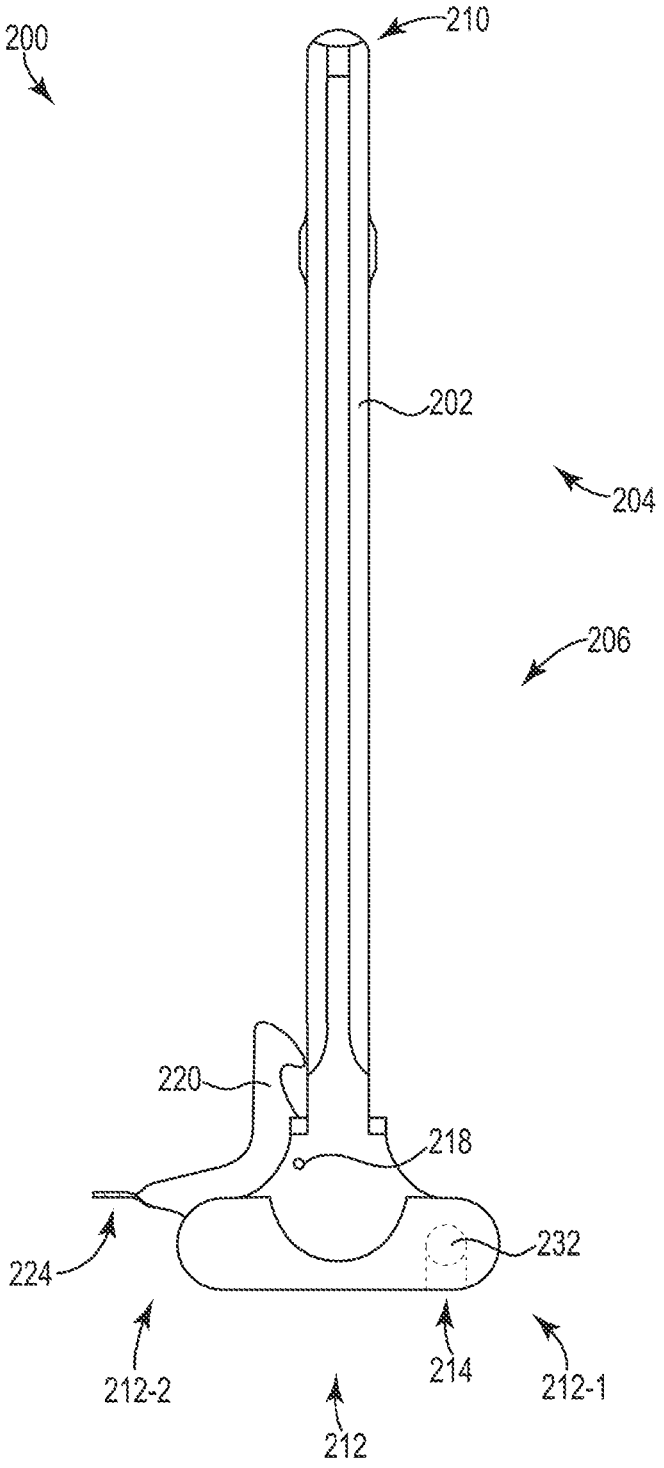
FIG. 2 illustrates a top view of a charging handle according to one or more embodiments of the present disclosure.

FIG. 2 illustrates a top view of a charging handle 200 according to one or more embodiments of the present disclosure. The charging handle 200 is analogous in several respects to the charging handle 100 previously described in connection with FIG. 1. For instance, the charging handle 200 includes an elongate member 202 having a forward end 204 and a rearward end 206. At the forward end 204 is a bolt engaging element 210 configured to engage a bolt carrier of a firearm and allow movement of a bolt assembly forward or rearward. At the rearward end 206 is a handle portion 212.

Similarly, the handle portion 212 includes a first projection 212-1 (e.g., a first projection from the elongate member 202) and a second projection 212-2 opposing the first projection 212-1. The first projection 212-1 includes a first surface defining an elongate opening 214. The elongate opening 214 extends at least partially through the first projection 212-1. The elongate opening 214 can be configured to receive a first end of a lanyard, for instance. The second projection 212-2 includes a pin 218 passing through (e.g., into) the second projection 212-2, securing the second projection 212-2 to a latch 220. The latch 220 includes a second surface defining a second opening 224. As previously discussed, the latch 220 can be pivotally secured to the handle portion 212 (e.g., the second projection 212-2 of the handle portion 212) via the pin 218. The latch 220 can be pivotal about the pin 218 between a latched orientation and an unlatched orientation. The latch 220 can include a biasing mechanism (not shown) configured to bias the latch 220 in the latched orientation. The embodiment illustrated in FIG. 2 shows the latch in the latched orientation.

The embodiment illustrated in FIG. 2 includes an adjoining opening 232 (e.g., adjoining to the elongate opening 214) defined by a second surface of the first projection 212-1. The adjoining opening 232 can be substantially perpendicular to the elongate opening 214 and/or a longitudinal axis of the elongate member 202, though embodiments of the present disclosure are not so limited. The adjoining opening 232 connects with the elongate opening 214. In some embodiments, such as the embodiment shown in FIG. 2, the adjoining opening 232 can pass partially (and not fully) through the first projection 212-1. In other embodiments, the adjoining opening 232 can pass through (e.g., fully through) the first projection 212-1. In some embodiments, such as the embodiment shown in FIG. 2, the adjoining opening 232 can pass through a bottom surface of the first projection 212-2. In other embodiments, the adjoining opening 232 can pass through a top surface of the first projection 212-2 or a distal (e.g., side) surface of the first projection 212-2.

In some embodiments, a diameter of the adjoining opening 232 is larger than a diameter of the elongate opening 214. In other embodiments, the diameter of the adjoining opening 232 is not larger than the diameter of the elongate opening 214 (i.e., substantially equivalent to, or smaller than, a diameter of the elongate opening 214). The first end of a lanyard can be passed through the elongate opening 214, through the adjoining opening 232, and can be modified. In embodiments where the diameter of the adjoining opening 232 is larger than the diameter of the elongate opening 214, the modified first end of the lanyard can be sized to pass through the adjoining opening 232 and seat against the second surface defining the adjoining opening 232 (e.g., when the lanyard is pulled). Accordingly, the modification can prevent the first end of the lanyard from being withdrawn back through the elongate opening 214. In embodiments where the diameter of the adjoining opening 232 is not larger than the diameter of the elongate opening 214, the modified first end of the lanyard can be sized to seat against a surface through which the adjoining opening passes and thereby prevent the first end of the lanyard from being withdrawn back through both the adjoining opening 232 and the elongate opening 214.

Figure 3:
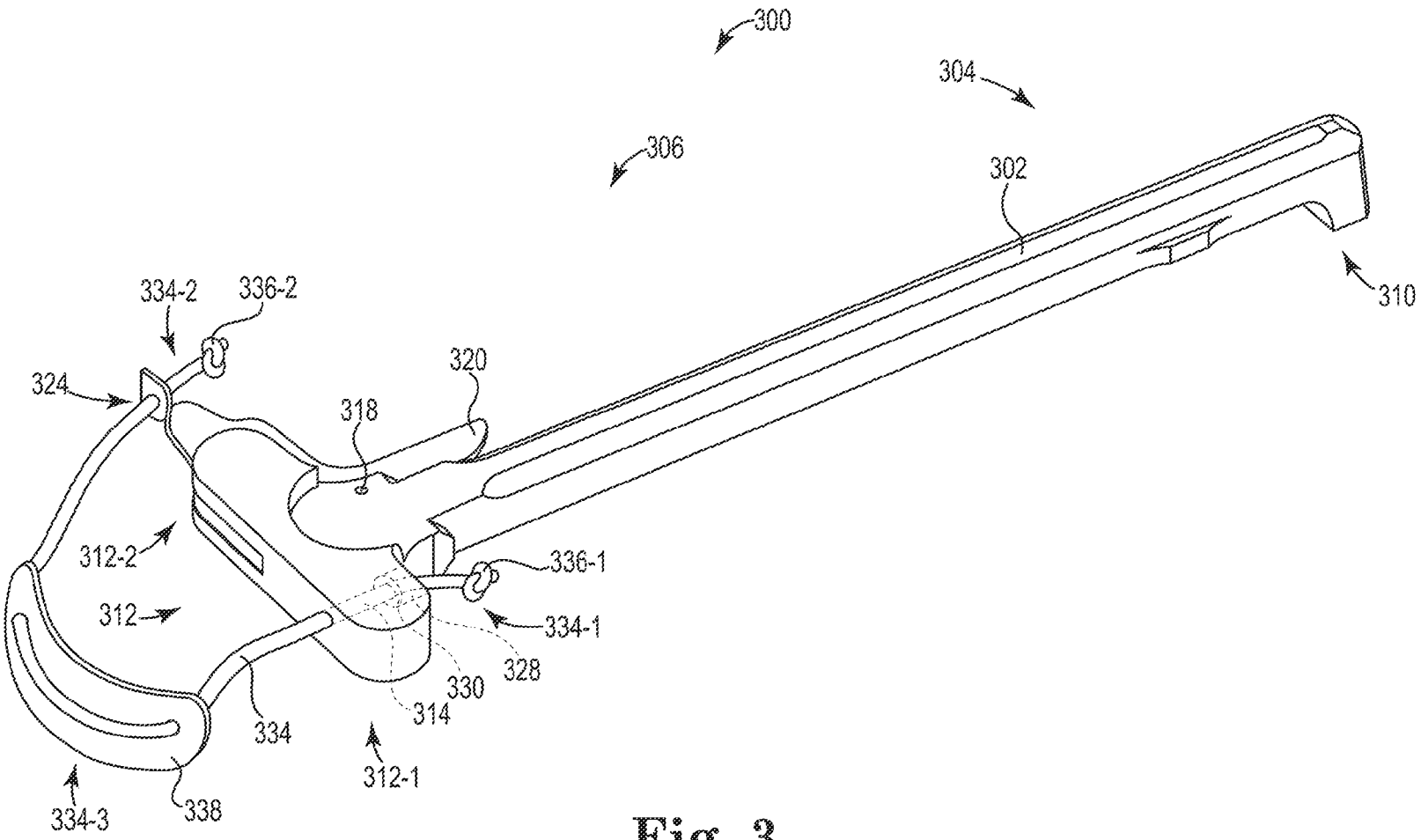
FIG. 3 illustrates a perspective view of a charging handle assembly according to one or more embodiments of the present disclosure.

FIG. 3 illustrates a perspective view of a charging handle assembly 300 according to one or more embodiments of the present disclosure. The charging handle assembly 300 is analogous in several respects to the charging handle 100 previously described in connection with FIG. 1. For instance, the charging handle assembly 300 includes an elongate member 302 having a forward end 304 and a rearward end 306. At the forward end 304 is a bolt engaging element 310 configured to engage a bolt carrier of a firearm and allow movement of a bolt assembly forward or rearward. At the rearward end 306 is a handle portion 312.

Similarly, the handle portion 312 includes a first projection 312-1 (e.g., a first projection from the elongate member 302) and a second projection 312-2 opposing the first projection 312-1. The first projection 312-1 includes a first surface defining an elongate opening 314. The elongate opening 314 extends at least partially through the first projection 312-1. The elongate opening 314 can be configured to receive a first end 334-1 of a lanyard 334, for instance. The second projection 312-2 includes a pin 318 passing through (e.g., into) the second projection 312-2, securing the second projection 312-2 to a latch 320. The latch 320 includes a second surface defining a second opening 324. As previously discussed, the latch 320 can be pivotally secured to the handle portion 312 (e.g., the second projection 312-2 of the handle portion 312) via the pin 318. The latch 320 can be pivotal about the pin 318 between a latched orientation and an unlatched orientation. The latch 320 can include a biasing mechanism (not shown) configured to bias the latch 320 in the latched orientation. The embodiment illustrated in FIG. 3 shows the latch in the latched orientation.

As shown in the embodiment illustrated in FIG. 3, the first projection 312-1 (e.g., the first surface of the first projection 312-1) can include a second surface defining a concentric opening 328. The concentric opening 328 can be substantially parallel with the elongate opening 314 and a longitudinal axis of the elongate member 302. The concentric opening 328 can have a diameter larger than a diameter of the elongate opening 314. A transition between the concentric opening 328 and the elongate opening 314 (e.g., the second surface defining the concentric opening 328 and the first surface defining the elongate opening 314) can define an annular ledge 330.

As shown, the first end 334-1 of the lanyard 334 can be passed through the elongate opening 314, through the concentric opening 328, and can be modified to a modified first end 336. The modified first end 336-1 can be sized to pass through the concentric opening 328 and seat against the annular ledge 330 (e.g., when the lanyard 334 is pulled). Accordingly, the modified first end 336-1 of the lanyard 334 can be prevented from being withdrawn back through the elongate opening 314.

The second surface defining the second opening 324 through the latch 320 can be configured to receive a second end 334-2 of the lanyard 334. As shown, the second end 334-2 of the lanyard 334 can be passed through the second opening 324 and can be modified to a modified second end 336-2. The modified second end 336-2 can be sized to seat against a surface of the latch 320 (e.g., when the lanyard 334 is pulled). Accordingly, the modified second end 336-2 of the lanyard 334 can be prevented from being withdrawn back through the second opening 324. The first end 334-1 of the lanyard 334 passing through the first projection 312-1 and the second end 334-2 of the lanyard 334 passing through the latch 320 form a loop portion 334-3, which is prevented from being broken by the modified first end 336-1 and the modified second end 336-2. A size of the loop portion 334-3 can be selected to accept a finger therein. In some embodiments, a size of the loop portion 334-3 can be selected to accept a gloved finger therein.

The lanyard 334 can include at least one filament. In some embodiments, the lanyard 334 can include a plurality of filaments, which may be braided together. In some embodiments, the at least one filament can be a synthetic polymer, such as a nylon resin, for instance. A suitable example of a nylon resin includes, but is not limited to, Zytel® nylon resin (DuPont). In some embodiments, the at least one filament can be a naturally-occurring substance, such as leather or hemp, for instance. In some embodiments, the at least one filament can be a metal or a metal alloy. In some examples, the lanyard 334 can be a cord, wire, string, thread, and/or cable, though embodiments of the present disclosure are not so limited.

The modification to either the first end 334-1 or the second end 334-2 to form the modified first end 336-1 and the modified second end 336-2 can be a modification selected such that either the modified first end 336-1 or the modified second end 336-2 is prevented from being withdrawn through its respective opening. In some embodiments modifying can include increasing a cross-sectional area of the end(s) of the lanyard 334. In some embodiments, modifying can include increasing a diameter of the end(s) of the lanyard 334. In some embodiments, the end(s) of the lanyard 334 can be knotted (e.g., in an overhand knot). In some embodiments, the end(s) of the lanyard 334 can be compressed and/or stretched to prevent withdrawal. In some embodiments, the end(s) of the lanyard can be secured to one or more mechanical stops. Mechanical stops in accordance with embodiments of the present disclosure are not limited to a particular shape and can include beads, plates, bars, balls, and/or blocks, among others. Securing the end(s) of the lanyard to one or more mechanical stops can include knotting, binding, welding, soldering, fusing, adhering, fastening, and/or melding, among others.

The loop portion 334-3 of the lanyard 334 can include a user engagement element 338 (e.g., to receive a finger of a user). The user engagement element 338 can have a surface area greater than a surface area of the loop portion 334-3, for instance, to provide ergonomic comfort to a user pulling on the lanyard 334. The user engagement element 338 may be a flap, a patch, a strip, a strap, a pad, or others. The user engagement element 338 may be composed of a synthetic polymer, such as a nylon resin, for instance. A suitable example of a nylon resin includes, but is not limited to, Zytel® nylon resin (DuPont). The user engagement element 338 may be composed of a naturally-occurring substance, such as leather, for instance. The user engagement element 338 may have a radius of curvature adapted to receive a finger, or, in some embodiments, a gloved finger. The user engagement element 338 may include a rough and/or textured surface, such as striations, cross hatching or knurling, for instance.

In some embodiments, the user engagement element 338 may be of unitary construction (e.g., as shown in the embodiment illustrated in FIG. 3). In other embodiments, the user engagement element 338 may include one or more components. For example, the user engagement element 338 may include a plurality of fibers (e.g., parachute cord and/or 550 cord) woven together. Such a weave can include, for example, a braid knot, a chain sinnet, and/or a Portuguese sinnet, among others.

In some embodiments, the user engagement element 338 may include one or more knots tied using the loop portion 334-3 of the lanyard 334. In one such example, the user engagement element 338 can include a monkey's first (or monkey paw) at the loop portion 334-3. A user, in addition to having the capability of pulling rearward on the loop portion 334 by inserting a finger therein, can grasp the knot and pull rearward.

The user engagement element 338 can be configured to magnetically engage one or more portions of a firearm. Accordingly, the lanyard 334 can be secured in a desired position when not in use. Such embodiments are discussed further below in connection with FIG. 5.

Figure 4:
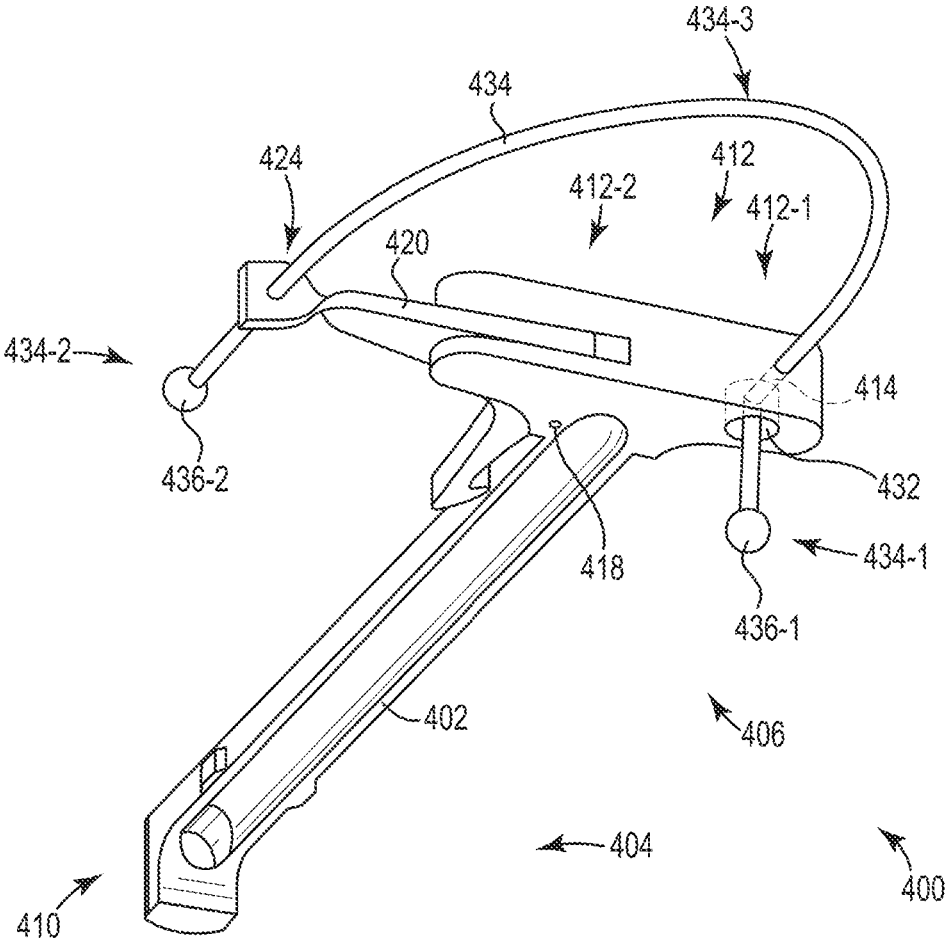
FIG. 4 illustrates a perspective view of a charging handle assembly according to one or more embodiments of the present disclosure.

FIG. 4 illustrates a perspective view of a charging handle assembly 400 according to one or more embodiments of the present disclosure. The charging handle assembly 400 is analogous in several respects to the charging handle 200 previously described in connection with FIG. 2. For instance, the charging handle assembly 400 includes an elongate member 402 having a forward end 404 and a rearward end 406. At the forward end 404 is a bolt engaging element 410 configured to engage a bolt carrier of a firearm and allow movement of a bolt assembly forward or rearward. At the rearward end 406 is a handle portion 412.

Similarly, the handle portion 412 includes a first projection 412-1 (e.g., a first projection from the elongate member 402) and a second projection 412-2 opposing the first projection 412-1. The first projection 412-1 includes a first surface defining an elongate opening 414. The elongate opening 414 extends at least partially through the first projection 412-1. The elongate opening 314 can be configured to receive a first end 434-1 of a lanyard 434, for instance. The second projection 412-2 includes a pin 418 passing through (e.g., into) the second projection 412-2, securing the second projection 412-2 to a latch 420. The latch 420 includes a second surface defining a second opening 424. As previously discussed, the latch 420 can be pivotally secured to the handle portion 412 (e.g., the second projection 412-2 of the handle portion 12) via the pin 418. The latch 420 can be pivotal about the pin 418 between a latched orientation and an unlatched orientation. The latch 420 can include a biasing mechanism (not shown) configured to bias the latch 420 in the latched orientation. The embodiment illustrated in FIG. 4 shows the latch in the latched orientation.

In a manner analogous to the charging handle 200 previously described in connection with FIG. 2, the embodiment illustrated in FIG. 4 includes an adjoining opening 432 (e.g., adjoining to the elongate opening 414) defined by a second surface of the first projection 412-1. The adjoining opening 428 can be substantially perpendicular to the elongate opening 414 and/or a longitudinal axis of the elongate member 402, though embodiments of the present disclosure are not so limited. The adjoining opening 432 connects with the elongate opening 414. In some embodiments, such as the embodiment shown in FIG. 4, the adjoining opening 432 can pass partially (and not fully) through the first projection 412-1. In other embodiments, the adjoining opening 432 can pass through (e.g., fully through) the first projection 412-1. In some embodiments, such as the embodiment shown in FIG. 4, the adjoining opening 432 can pass through a bottom surface of the first projection 412-2. In other embodiments, the adjoining opening 432 can pass through a top surface of the first projection 412-2 or a distal (e.g., side) surface of the first projection 412-2.

As shown in the embodiment illustrated in FIG. 4, a diameter of the adjoining opening 432 can be larger than a diameter of the elongate opening 214. The first end 434-1 of a lanyard 434 can be passed through the elongate opening 414, through the adjoining opening 432, and can be modified to a modified first end 436-2. The modified first end 436-1 is illustrated as a mechanical stop in the charging handle assembly 400, though, as previously discussed, embodiments of the present disclosure are not so limited. The modified first end 436-1 of the lanyard 434 can be sized to pass through the adjoining opening 432 and seat against the second surface defining the adjoining opening 432 (e.g., when the lanyard 434 is pulled). Accordingly, the modified first end 436-1 of the lanyard 434 can be prevented from being withdrawn back through the elongate opening 414.

The second surface defining the second opening 424 through the latch 420 can be configured to receive a second end 434-2 of the lanyard 434. As shown, the second end 434-2 of the lanyard 434 can be passed through the second opening 424 and can be modified to a modified second end 436-2. The modified second end 436-2 can be sized to seat against a surface of the latch 420 (e.g., when the lanyard 434 is pulled). Accordingly, the modified second end 436-2 of the lanyard 434 can be prevented from being withdrawn back through the second opening 424. The first end 434-1 of the lanyard 434 passing through the first projection 412-1 and the second end 434-2 of the lanyard 434 passing through the latch 420 form a loop portion 434-3. A size of the loop portion 434-3 can be selected to accept a finger therein. In some embodiments, a size of the loop portion 434-3 can be selected to accept a gloved finger therein.

In contrast to the charging handle 300 illustrated in FIG. 3, the embodiment shown in FIG. 4 does not include a user engagement element. In some examples, users may engage the loop portion 434-3 of the lanyard directly with a finger, for instance. In some embodiments, users may engage the loop portion 434-3 with a device, such as a hook, calipers, or bow string drawing and releasing device, for instance, among others.

Figure 5:
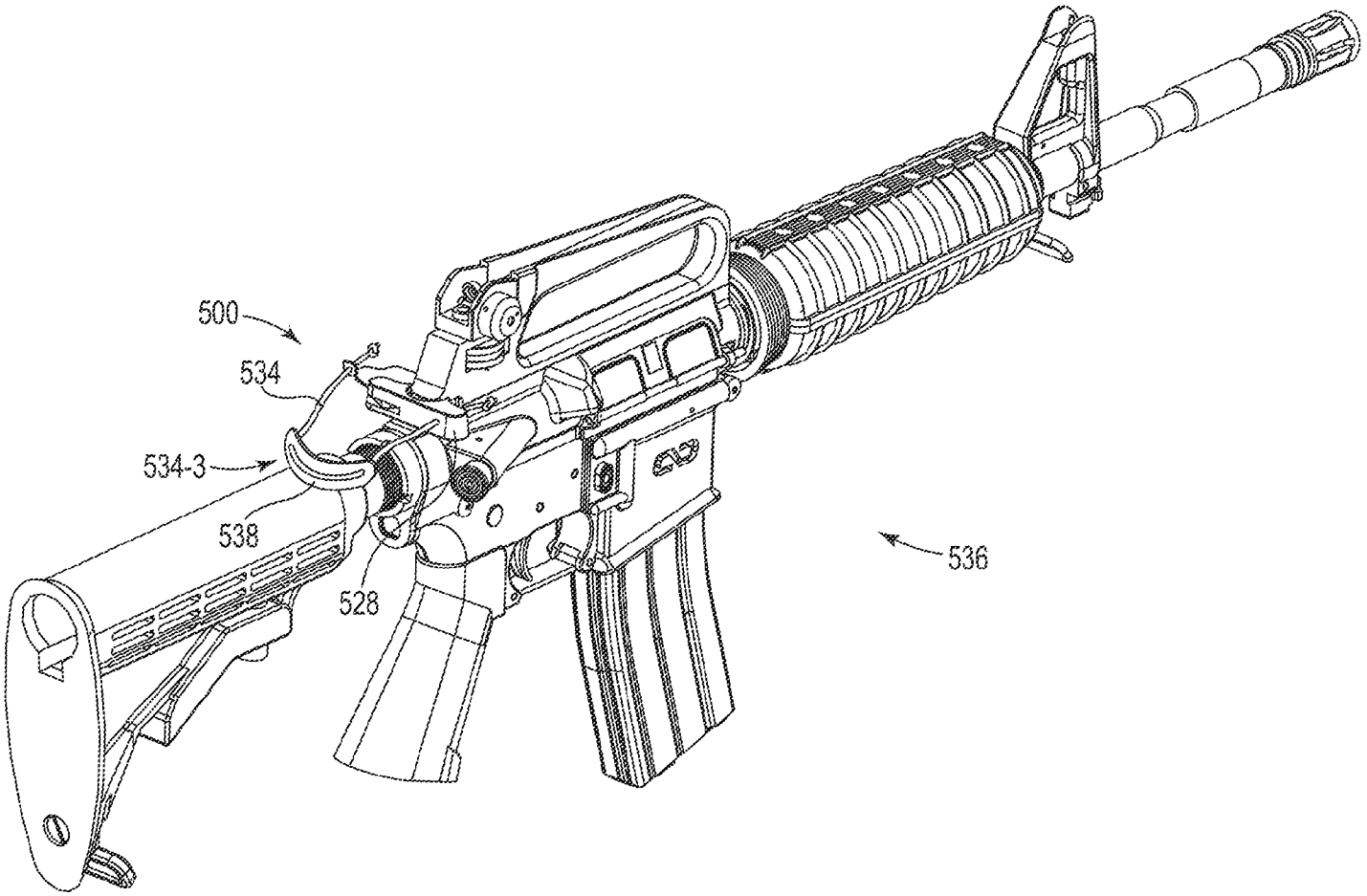
FIG. 5 illustrates a perspective view of a firearm having a charging handle assembly according to one or more embodiments of the present disclosure.

FIG. 5 illustrates a perspective view of a firearm 536 having a charging handle assembly 500 according to one or more embodiments of the present disclosure.

The Firearm 536 can be an AR-10, AR-15, M-16, or M4 series, or a subsequent AR-10 type, AR-15 type, M-16 type, and M4 type firearm or derivative thereof. These firearms are manufactured and/or sold by entities such as Colt's Manufacturing Company of Hartford, Conn., Fabrique Nationale d'Herstal (FN) of Herstal, Belgium, Bushmaster Firearms International of Madison, N.C., Defense Procurement Manufacturing Services (DPMS) Panther Arms of St. Cloud Minn., and many others.

Visible in the embodiment illustrated in FIG. 5 is a lanyard 534 attached to a handle portion of the charging handle assembly 500 through an annular opening 528. The lanyard 534 includes a loop portion 534-3, which includes a user engagement element 538. The charging handle assembly illustrated in FIG. 5 may be analogous to the charging handle assembly 300 previously described in connection with FIG. 3. Some elements of the charging handle assembly 500 are obscured by other portions of the firearm 536. For instance, a portion of an elongate member of the charging handle assembly is disposed in a channel of the firearm 536.

A force applied rearward to the loop portion 534-3 (e.g., via the user engagement element 538) can move a latch of the charging handle 500 from a latched orientation to an unlatched orientation. Subsequent force applied rearward (e.g., force applied after the latch has been moved to the unlatched orientation) can move the charging handle assembly 500 rearward in the channel. Thus, a user applying a pulling force to the loop portion 534-3 of the lanyard 534 can unlatch the charging handle assembly 500 and slide it rearward in the channel.

As previously discussed, the user engagement element 538 can be configured to magnetically engage one or more portions of the firearm 536. That is, the loop portion 534-3 of the lanyard 534 can be secured in a desired position when not in use. In one example, the user engagement element 538 can include a monkey's first knot tied around a magnet (e.g., a neodymium magnet). The magnet can magnetically engage one or more portions (e.g., magnetic and/or ferromagnetic portions) of the firearm 536. Accordingly, the knot can be configured to be secured at a desired position, such as either side of a butt plate adapter of the firearm 536 and/or a particular location on a stock of the firearm 536, for instance.

In other embodiments, the user engagement element can include a monkey's first knot tied around a ferromagnetic component (e.g., a steel ball). One or more magnets can be secured to the firearm 536 (e.g., in the stock or on the butt plate adapter) and configured to magnetically engage and secure the knot at a particular location with respect to the firearm 536. The magnets can be secured to a surface of the firearm 536 and/or recessed into (or under) a surface of the firearm 536.

Figure 6:
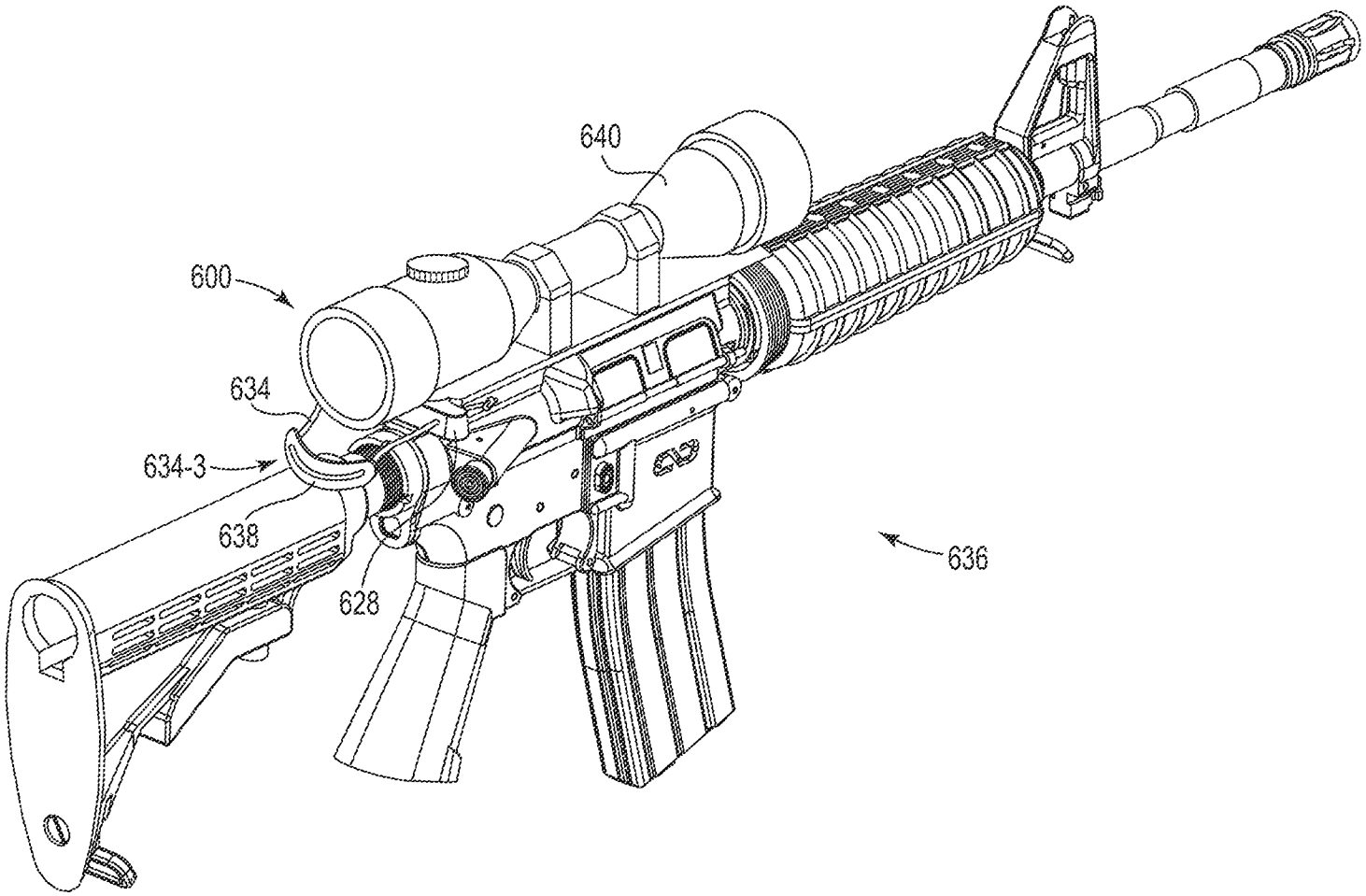
FIG. 6 illustrates a perspective view of a firearm having a telescopic sight and a charging handle assembly according to one or more embodiments of the present disclosure.

FIG. 6 illustrates a perspective view of a firearm 636 having a telescopic sight (e.g., scope) 640 and a charging handle assembly 600 according to one or more embodiments of the present disclosure.

The Firearm 636 can be an AR-10, AR-15, M-16, or M4 series, or a subsequent AR-10 type, AR-15 type, M-16 type, and M4 type firearm or derivative thereof. These firearms are manufactured and/or sold by entities such as Colt's Manufacturing Company of Hartford, Conn., Fabrique Nationale d'Herstal (FN) of Herstal, Belgium, Bushmaster Firearms International of Madison, N.C., Defense Procurement Manufacturing Services (DPMS) Panther Arms of St. Cloud Minn., and many others.

The telescopic sight 640 is an optical device configured to be mounted on (or affixed to) the firearm 636 and is not intended to be limited to a particular type, style, size, and/or configuration. For example, the telescopic sight 640 can include one or more lens hoods, covers, and/or optical filters. The telescopic sight 640 can include an illuminated reticle, fiber optic components, batteries, infrared imaging capabilities, etc.

Visible in the embodiment illustrated in FIG. 6 is a lanyard 634 attached to a handle portion of the charging handle assembly 600 through an annular opening 628. The lanyard 634 includes a loop portion 634-3, which includes a user engagement element 638. The charging handle assembly illustrated in FIG. 6 may be analogous to the charging handle assembly 300 previously described in connection with FIG. 3. Some elements of the charging handle assembly 600 are obscured by other portions of the firearm 636. For instance, a portion of an elongate member of the charging handle assembly is disposed in a channel of the firearm 636.

A force applied rearward to the loop portion 634-3 (e.g., via the user engagement element 638) can move a latch of the charging handle 600 from a latched orientation to an unlatched orientation. Subsequent force applied rearward (e.g., force applied after the latch has been moved to the unlatched orientation) can move the charging handle assembly 600 rearward in the channel. Thus, a user applying a pulling force to the loop portion 634-3 of the lanyard 634 can unlatch the charging handle assembly 600 and slide it rearward in the channel.

Whereas, under previous approaches, a user may find difficulty grasping a charging handle when a telescopic sight (or other optical device), such as the telescopic sight 640, is mounted on the firearm 636, the embodiment illustrated in FIG. 6 illustrates that the loop portion 634-3 of the lanyard 634 is readily accessible as it is located rearward of the telescopic sight 640. Thus, a user can operate the charging handle 600 without being impeded by the presence of the telescopic sight 640.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A charging handle for a firearm, comprising:

an elongate member having a forward end and a rearward end with a longitudinal axis extending therethrough;

a bolt engaging element at the forward end;

a handle portion at the rearward end, the handle portion including a first projection from the elongate member and a second projection from the elongate member opposing the first projection, the first projection, non-pivoting with respect to the elongate member, having a first surface defining an elongate opening at least partially therethrough extending substantially parallel with the longitudinal axis of the elongate member and configured to receive a first end of a lanyard, and the second projection having at least one surface defining a pivot point opening with a pivot axis substantially perpendicular to the longitudinal axis of the elongate member;

a pivot pin in the pivot point opening; and a latch having a first surface defining a first opening therethrough and a second surface defining a second opening, the pivot pin passing through the first opening to allow the latch to pivot around the pivot pin positioned through the pivot opening and the first opening through the latch and the second opening configured to receive a second end of the lanyard.

2. The charging handle of claim 1, where the first surface defining the elongate opening further includes a second surface defining a concentric opening having a diameter larger than a diameter of the elongate opening, where a transition between the second surface and the first surface defines an annular ledge.

3. The charging handle of claim 1, where the first projection further includes a second surface defining an adjoining opening to the elongate opening defined by the first surface, where the adjoining opening extends in a direction substantially perpendicular to the longitudinal axis of the elongate member to connect with the elongate opening and has a diameter larger than a diameter of the elongate opening.

4. The charging handle of claim 1, where the second surface of the latch defining the second opening therethrough has a geometric center extending substantially parallel with the longitudinal axis of the elongate member.

5. The charging handle of claim 1, where the geometric center of the second opening through the latch and a geometric center of the elongate opening at least partially through the first projection are disposed on a common plane parallel with the longitudinal axis of the elongate member.

6. The charging handle of claim 5, where the geometric center of the second opening through the latch, the geometric center of the elongate opening at least partially through the first projection and the longitudinal axis of the elongate member are disposed on the common plane.

7. The charging handle of claim 1, where the latch includes a first portion positioned between and substantially parallel with two major surfaces of the handle portion, the first portion including the first opening to receive the pivot pin, a second portion that extends from the first portion and the longitudinal axis of the elongate member to a third portion having the surface defining the second opening therethrough, where the second portion twists around an axis that passes through the first portion the second portion and the third portion.

8. A charging handle assembly for a firearm, comprising:

an elongate member having a forward end and a rearward end with a longitudinal axis extending therethrough;

a bolt engaging element at the forward end;

a handle portion at the rearward end, the handle portion including a first projection from the elongate member and a second projection from the elongate member opposing the first projection, the first projection, non-pivoting with respect to the elongate member, having a first surface defining an elongate opening at least partially therethrough extending substantially parallel with the longitudinal axis of the elongate member and configured to receive a first end of a lanyard, and the second projection having at least one surface defining a pivot point opening with a pivot axis substantially perpendicular to the longitudinal axis of the elongate member;

a pivot pin in the pivot point opening;

a latch having a surface defining a first opening therethrough, the pivot pin passing through the first opening to allow the latch to pivot around the pivot pin positioned through the pivot opening and the first opening through the latch; and a lanyard having at least one filament with a first end portion and a second end portion opposite the first end portion, the first end portion passing through the elongate opening of the first projection and the second end portion passing through a second opening of the latch to form a loop portion, where each of the first end portion and the second end portion is modified to prevent the loop from being broken.

9. The charging handle assembly of claim 8, where the first end portion and the second end portion are modified by a respective knot at each of the first end portion and the second end portion to prevent the loop from being broken.

10. The charging handle assembly of claim 8, where the first end portion and the second end portion are modified with a mechanical stop to prevent the loop from being broken.

11. The charging handle assembly of claim 8, where the first surface defining the elongate opening further includes a second surface defining a concentric opening having a diameter larger than a diameter of the elongate opening, where a transition between the second surface and the first surface defines an annular ledge, and where the modified first end portion of the lanyard is sized to pass through the concentric opening and seat against the annular ledge when the loop portion is pulled.

12. The charging handle assembly of claim 8, where the first projection further includes a second surface defining an adjoining opening to the elongate opening defined by the first surface, where:

the adjoining opening extends in a direction substantially perpendicular to the longitudinal axis of the elongate member to connect with the elongate opening and has a diameter larger than a diameter of the elongate opening; and where the modified first end portion of the lanyard is sized to pass through the adjoining opening and seat against the second surface defining the adjoining opening when the loop portion is pulled.

13. The charging handle assembly of claim 8, where a size of the loop portion of the lanyard is selected to accept a gloved finger therein.

14. The charging handle assembly of claim 8, where the lanyard has a plurality of filaments, where the plurality of filaments are braided together.

15. The charging handle assembly of claim 8, where the loop portion includes a user engagement element to receive a finger of a user.

16. A firearm, comprising:

a firearm charging handle, including:

an elongate member having a forward end and a rearward end with a longitudinal axis extending therethrough;

a bolt engaging element at the forward end;

a handle portion at the rearward end, the handle portion including a first projection from the elongate member and a second projection from the elongate member opposing the first projection, the first projection, non-pivoting with respect to the elongate member, having a first surface defining an elongate opening at least partially therethrough extending substantially parallel with the longitudinal axis of the elongate member and configured to receive a first end of a lanyard, and the second projection having at least one surface defining a pivot point opening with a pivot axis substantially perpendicular to the longitudinal axis of the elongate member;

a pivot pin in the pivot point opening;

a latch having a surface defining a first opening therethrough, the pivot pin passing through the first opening to allow the latch to pivot around the pivot pin positioned through the pivot opening and the first opening through the latch; and a lanyard having at least one filament with a first end portion and a second end portion opposite the first end portion, the first end portion passing through the elongate opening of the first projection and the second end portion passing through a second opening of the latch to form a loop portion, where each of the first end portion and the second end portion is modified to prevent the loop from being broken.

17. The firearm of claim 16 where the latch is pivotally secured to the handle portion and pivotal between a latched orientation and an unlatched orientation, the latch including a biasing mechanism configured to bias the latch in the latched orientation.

18. The firearm of claim 17, where a particular force applied rearward to the loop portion of the lanyard moves the latch from the latched orientation to the unlatched orientation.

19. The firearm of claim 18, where the elongate member is partially disposed in a channel of the firearm and where a subsequent force applied rearward to the loop portion of the lanyard moves the charging handle rearward in the channel.

* * * * *